US006299700B1

(12) United States Patent
Grobler

(10) Patent No.: US 6,299,700 B1
(45) Date of Patent: Oct. 9, 2001

(54) METHOD OF AND A DEVICE FOR OPERATING A POOL CLEANER

(75) Inventor: Johannes Stephanus Grobler, 173 Eeufees St., Pretoria North Pretoria GP 0182 (ZA)

(73) Assignee: Johannes Stephanus Grobler, Pretoria North (ZA)

( * ) Notice: Subject to any disclaimer, the term of this patent is extended or adjusted under 35 U.S.C. 154(b) by 0 days.

(21) Appl. No.: 09/424,605

(22) PCT Filed: May 22, 1998

(86) PCT No.: PCT/US98/10628

§ 371 Date: Nov. 24, 1999

§ 102(e) Date: Nov. 24, 1999

(87) PCT Pub. No.: WO98/53164

PCT Pub. Date: Nov. 26, 1998

(30) Foreign Application Priority Data

May 24, 1997 (ZA) ..... 97/2464

(51) Int. Cl.[7] ..... E04H 4/16

(52) U.S. Cl. ..... 134/21; 4/490; 15/1.7; 134/56 R; 134/111; 210/169; 210/416.2; 210/242.1

(58) Field of Search ..... 134/21, 56 R, 134/111, 22.18; 15/1.7; 4/490; 210/169, 416.2, 242.1

(56) References Cited

U.S. PATENT DOCUMENTS

| | | | | |
|---|---|---|---|---|
| 4,086,933 | * | 5/1978 | Pansini . | |
| 4,550,463 | | 11/1985 | Raubenheimer | 134/166 |
| 4,675,921 | | 6/1987 | Jean-Jacques | 134/167 |

* cited by examiner

*Primary Examiner*—Jan Ludlow
(74) *Attorney, Agent, or Firm*—Quarles & Brady LLP

(57) ABSTRACT

A pumping system of a pool (10) pumps water through a pool cleaner (20) and hose (26) connected to a weir (18). Flow through the cleaner (20) is cyclically interrupted to repeatedly reciprocate the hose (26). A device (30) anchored to the weir (18) is coupled to the hose (26) via clip (38). The reciprocal motion of the hose (26) is transmitted to the device (30) where it is transduced to a swinging motion (42) via a lever (40) attached to the hose (26) via clip (36), whereby the hose (26) is moved cyclically in attitude and position to promote random motion of the cleaner (20) and to render the cleaner (20) less likely to get stuck.

14 Claims, 3 Drawing Sheets

METHOD OF AND A DEVICE FOR OPERATING A POOL CLEANER

THIS INVENTION relates to method of operating a pool cleaner and to a device for use in operating a pool cleaner.

Pool cleaners, such as pool cleaners widely in use to clean swimming pools, for example currently available in South Africa under the trade names or trademarks KREEPY KRAULY and BARACUDA, pass water from a head in a pool cleaner body via a hose into and through a pump system of the pool. The flow stream of water is cyclically interrupted in the pool cleaner body which causes a corresponding, cyclic stop-start motion in the body and in turn causes a cyclic water hammer action and a cyclic to and fro motion in the hose. The hose is at least slightly resilient in a longitudinal direction such that its end, remote from the pool cleaner body, can be fixed to a rigid connecting member of a pump system. Said stop-start motion causes a pool cleaner body to move generally along the line of the hose portion proximate the body. Various ways and means are provided to cause the pool cleaner body to follow a random path and not a pattern such that the whole of the emerged pool surface is covered.

However, the applicant has identified two problems in the kind of pool cleaner described. First, the movement of the body is not in practice entirely random, but does follow a pattern, which may be caused by a specific pool layout, such that some portions of the submerged surface are covered excessively, while other portions are neglected or nor covered at all. Secondly it does happen that a steady state condition comes about, especially when the body is in a corner of the pool, and the body gets stuck in one position. It is an object of this invention to alleviate those problems.

In accordance with a first aspect of the invention, there is provided a method of operating a pool cleaner of the general kind described including, mechanically, continually or continuously moving the hose at a position remote from a body of the pool cleaner.

By "mechanically" is meant that the method step is effected "non-manually".

Moving the hose may include changing at least one of an attitude and a location of a portion of the hose.

The method step may include preferably changing both the attitude and the location of the hose portion.

The applicant believes that the effect of those changes is equivalent to changing the position of the weir in relation to the layout of the pool.

The method may include cyclically oscillating a specific point of said hose portion. The movement may be along an arc. It may be in a horizontal plane, conveniently generally along the surface of the water.

Advantageously, energy associated with pumping of the water through the hose may be used to move the hose. In a preferred method, reciprocation or to and fro movement of the hose may be transmitted to a mechanical device adapted to transduce the reciprocating motion into the motion to which said specific point on the hose portion is subjected. The method may thus include transmitting reciprocating motion of the hose via a lever, pawl-fashion, to a wheel to rotate the wheel, and transducing rotation of the wheel to arcuate wiping motion transmitted to the hose. Rotation of the wheel may be reduced in one or more reduction gear steps forming part of a gear train. Rotation of a gear wheel at a downstream end of the gear train may be transmitted by means of a crank mechanism to an arm to impart cyclic arcuate wiping or swinging motion to the arm, the hose being connected to the arm to be moved in concert with the arm.

The invention extends in respect of a second aspect to a guiding device suitable for use in operating a pool cleaner of the general kind described by mechanically, continually or continuously, moving the hose at a position remote from a body of the pool cleaner, the device including a driven member arranged to be driven, a transducer connected to the driven member and adapted to transduce motion of the drive member to motion to be imparted to the hose; and a transmission member arranged to transmit motion from the transducer to the hose.

The driven member may be in the form of a lever having a fulcrum, a force point connected to the hose, and a load point connected to a wheel. The load point may be releasably connected to the wheel by means of a connection device adapted to connect the load point to the wheel when motion of the lever is in a first direction, and to disconnect the lever from the wheel when motion of the lever is in a second direction opposed to the first direction. Thus, the wheel will be turned in one direction only. If desired, a releasable check device may be provided to allow turning of the wheel in said one direction only i.e to check the wheel against rotation in a direction opposite to said one direction.

The device may include a speed reduction mechanism drivingly connected to said wheel. It may include cogs on said wheel to render said wheel a gear wheel, and one or more gear wheels forming a speed reducing gear train.

Said speed reducing gear train may have a final wheel and a pivot on said wheel parallel to and spaced from an axis of said final wheel. The transmission member may be in the form of a lever pivoted at a fulcrum thereof, a load point of the lever being connected by means of a connecting link to said pivot of said final wheel. The arrangement is adapted to impart arcuate wiping motion to the hose.

BRIEF DESCRIPTION OF THE DRAWINGS

The invention is now described by way of example with reference to the following diagrammatic drawings. In the drawings

With reference to FIG. 1 of the drawings, a pool being cleaned is generally indicated by reference numeral 10. It has walls 12, a floor or bottom 14 and is filled by water 16. It has a weir 18 in one wall leading to a pumping system for the pool.

Figure 1:
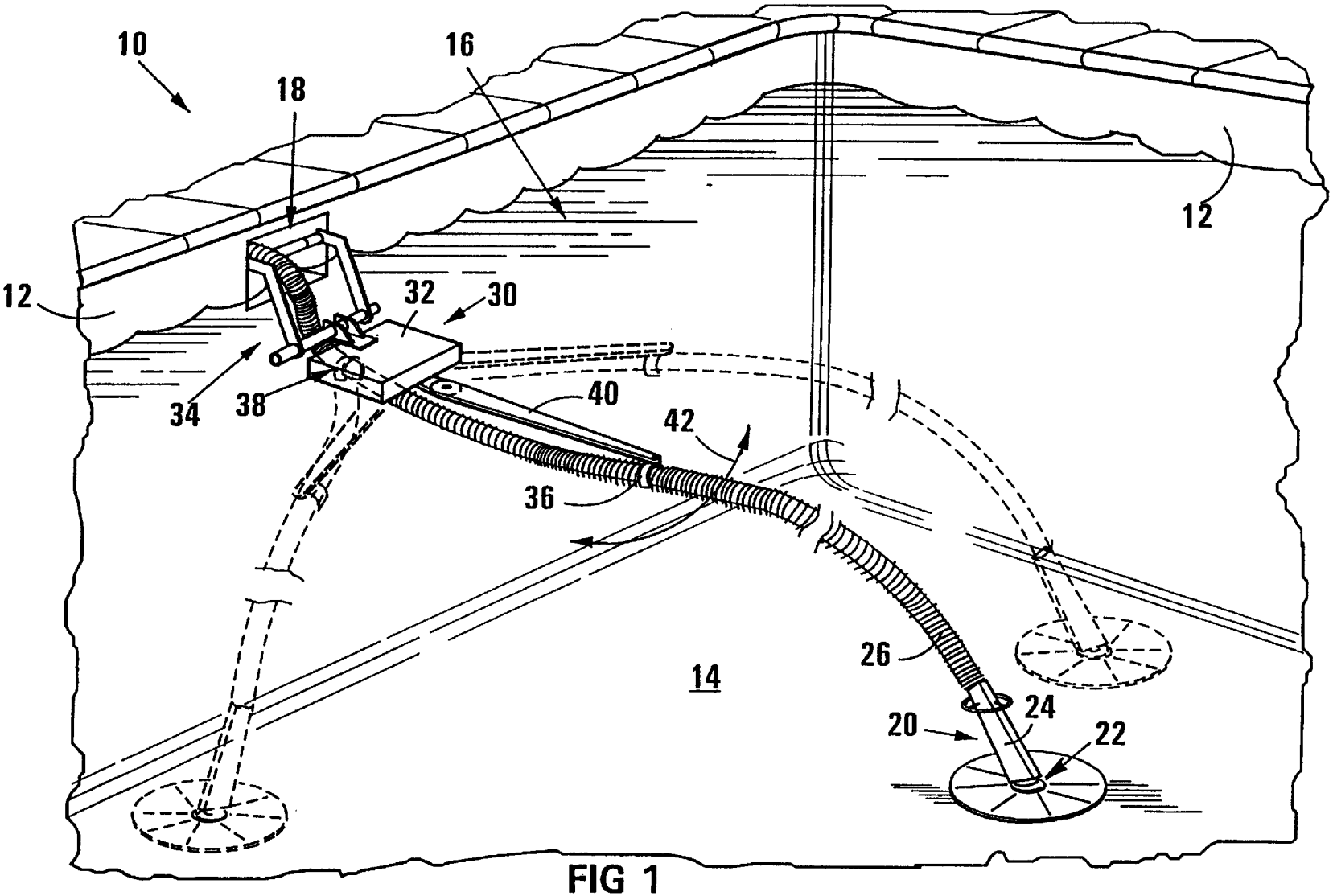
FIG. 1 shows, in three dimensional view, a pool being cleaned by means of a pool cleaner operated in accordance with the invention by means of a pool cleaner guiding device.

A conventional pool cleaner 20 is in use cleaning the pool 10. The pool cleaner 20 has a cleaning head 22, a body 24 and a hose 26 connected to the pumping system of the pool at the weir 18.

As mentioned above, the pool cleaner 20 passes water pumped by the pool pumping system via the head 22, body 24 and hose 26 to the pool pumping system. The flow of water is interrupted in the head or body which causes a stop-start motion in the head and body and which causes the head and body to translate across surfaces of the pool to be cleaned. It also causes reciprocation or to and fro motion in the hose 26 which is slightly resilient.

Broadly, in accordance with the invention, there is provided a guiding device generally indicated by reference numeral 30 which has a body 32 anchored by means of an anchor bracket 34 to the weir 18. The body 32 is preferably buoyant to cause it to float on the water surface 16. The anchor bracket 34 is pivotally attached to the weir 18 and also to the body 32 to allow the body 32 to rise and fall with the surface of the water 16. This has an added advantage in that, should an object or person fall or step on the body 32, it can pivot downwardly to allow the object or body to pass without offering much resistance. This is regarded as an important safety feature.

Further in accordance with the invention, to and fro motion or reciprocation of the hose 26 is used as an energy source to drive the device 30 as will be described hereinafter. The device 30 is driven ultimately to cause a guide lever 40 forming part of the device to perform a wiping or swinging motion generally indicated by reference numeral 42. At a free end of the guide lever 40, it is connected by means of a guide clip 36 to the hose 26 at a position remote from the body 24 of the pool cleaner 20. It is to be understood that such wiping motion takes place slowly and it takes place through a wide arc, only slightly smaller than 180°. Being connected by means of a guide clip 36 to the hose 26, that position of the hose 26 moves in concert with the guide lever 40 and thus continually changes both the attitude of the hose at that point, and also the position of the hose at that point. As mentioned above, the applicant believes that such changing in the attitude and position of the point on the hose 26 will enhance the degree to which the pool cleaner traverses the whole of the surface to be cleaned and furthermore will enhance the ability of the pool cleaner to work itself out of potentially stuck positions e.g. out of corners of the pool 10.

Figure 2:
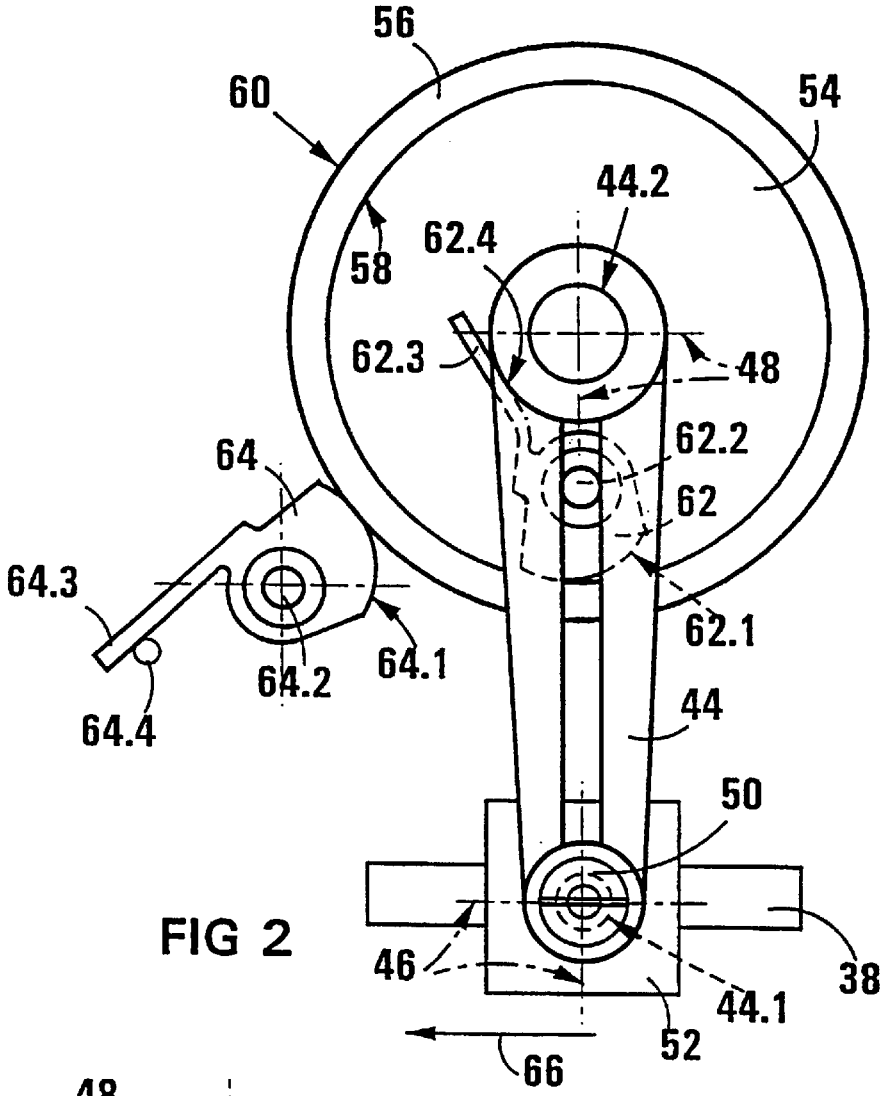
FIGS. 2 and 3 shows respectively in plan view and in side view a driving mechanism forming part of the device of FIG. 1.
Figure 3:
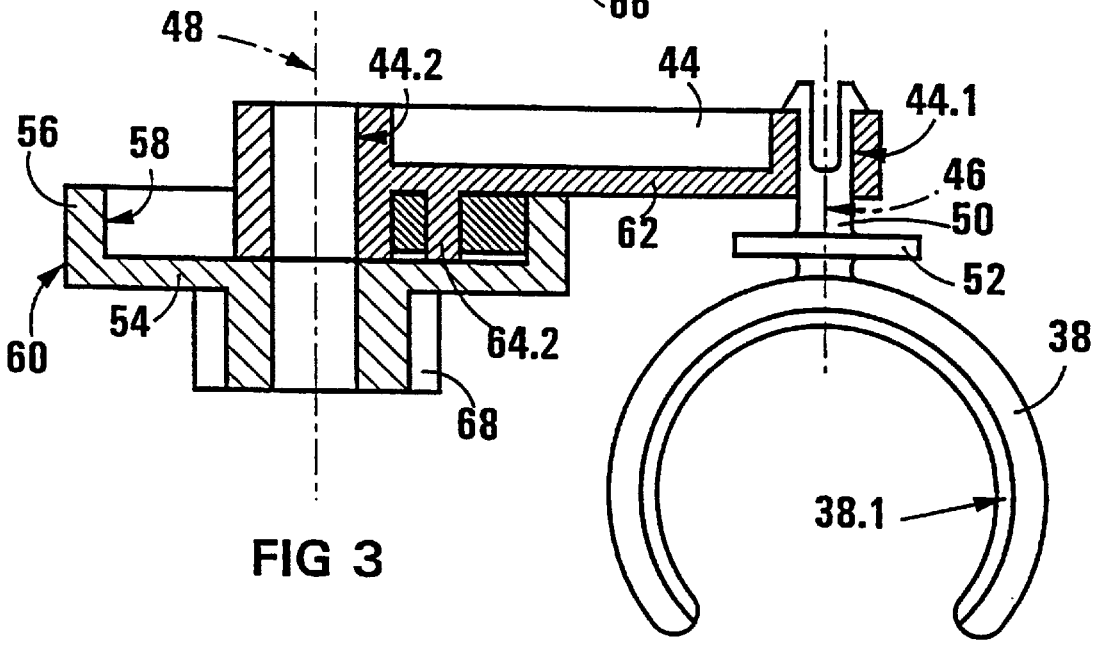

With reference also to FIGS. 2 and 3 of the drawings, underneath the body 32 of the device 30, the hose 26 is connected by means of an actuating clip 38 such as to drive the device 30.

The actuating clip 38 is resilient such that it can engage the hose. Advantageously, it has an inner male ridge 38.1 receivable snugly in a female groove in the hose 26. It is to be understood that, because the hose 26 is to be resilient, it is continuously ribbed, bellows fashion and the male ridge 38.1 thus seats intermediate adjacent ribs thus to locate it axially without lost motion on the hose 26.

The clip 38 has an integral shaft 50 which has a split, resilient end with a circumferential clip-on formation enabling it to be clipped into an aperture 44.1 through a boss provided at one end of a lever 44. Thus, the clip 38 is pivotally received on the lever 44. Generally, the lever 44 will extend transversely relative to the axis of the clip 38 and thus transversely also to the hose 26.

At an opposed end of the lever 44 it has an aperture 44.2 through a boss via which it is pivoted by means of a spindle, which is not shown, to the body 32. Also pivoted about the same spindle, there is provided a wheel 54 which is in coaxial with the aperture 44.2.

Closely spaced from the aperture 44.2, the lever 44 defines a projecting stub 64.2.

The wheel 54 has a circumferential flange or rim 56 having an inner circumferential surface 58 and an outer circumferential surface 60, both being concentric with an axis 48 about which the wheel 54 is pivoted.

A connecting pawl or cam 62 is pivotally mounted on the stub 64.2. The connecting pawl or cam 62 has a cam surface 62.1 lying against the inner circumferential surface 58 of the wheel 54. The pawl 62 further has a resilient tail 64.3 which is checked against a check surface 64.4 on a boss of the lever 44 defining the aperture 44.2.

A similar pawl or cam 64 is provided pivoted via a stub 64.2 on the body 32 such that a cam surface 64.1 thereof lies against the outer circumferential surface 60 of the wheel 54. A resilient tail 64.3 is checked against a check member 64.4 provided for that purpose on the body 32.

The arrangements of the pawls 62, 64, and more specifically the arrangement of the cam surfaces 62.1 and 64.1, are such that, when the lever 44 is pivoted about the pivot axis 48 during reciprocation of the hose 26 such that the force point of the lever 44, represented by its axis 46 about which the clip 38 is pivoted, moves in the direction of arrow 66, the cam surface 62.1 frictionally checks against the inner circumferential surface 58 such that the wheel 54 is pivoted with the lever 44.

During the succeeding portion of reciprocation of the hose 26, when the axis 46 is moved in a direction opposite to the direction of arrow 66, the pawl 62 releases from the inner circumferential surface 58 to allow the lever 44 to return on its own. Simultaneously, the pawl 64 and more specifically its cam surface 64.1 frictionally engages and brakes the wheel 54 via its outer circumferential surface 66 such that the wheel 54 is braked and does not return with the lever 44. In this fashion, similar to a ratchet action, the wheel 54 is cyclically pivoted in small steps in a direction which is clock-wise as seen in FIG. 2.

Figure 4:
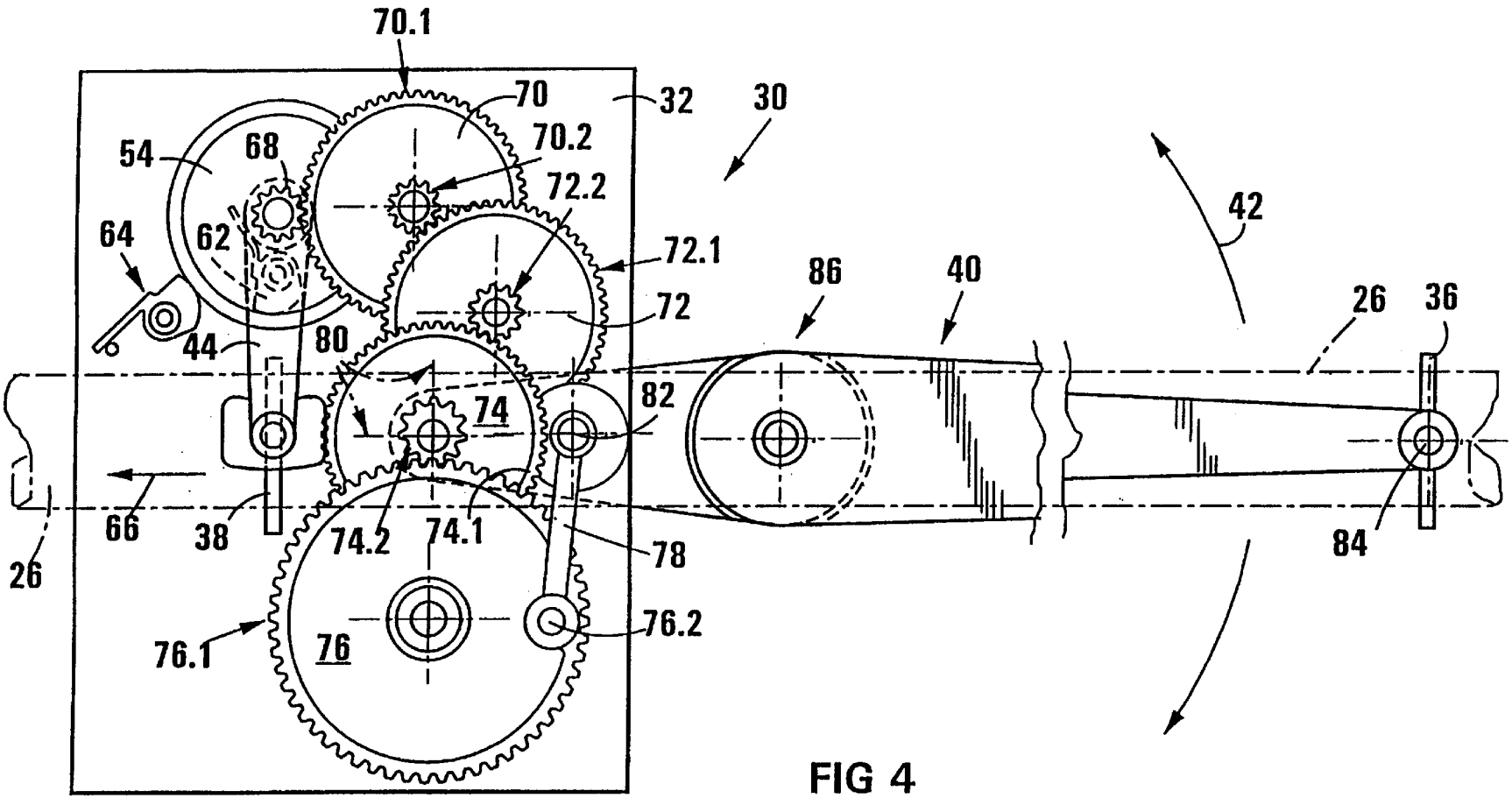
FIG. 4 shows, in plan view, in more detail, the device of FIG. 1.

The wheel 54 has cogs 68 at a relatively small diameter which cogs mesh, as can best be seen in FIG. 4, with outer circumferential cogs 70.1 of a gear wheel 70. The gear wheel 70 also has cogs 70.2 at a small diameter which mesh in turn with cogs 72.1 of a gear wheel 72 at a large diameter. The gear wheel 72 in turn has cogs 72.2 at a small diameter. In turn further gear wheel 74 and a final gear wheel 76, together with the gear wheels 70 and 72 as well as the cogs 68 form a reduction gear train. It is to be appreciated that a very large speed reduction is provided as there are four reduction steps in the gear train. The final gear wheel 76 has, close to is periphery, a stub 76.2.

It is to be appreciated that all of the gear wheels are rotatable about parallel axes i.e parallel to the axis of the wheel 54.

Further with reference to FIG. 4, the guide lever 40 is pivoted about an axis 80 on the body 32. The axis 80 is conveniently co-axial with the axis of the gear wheel 74. The axis 80 serves as a fulcrum for the lever 40, while the connection of the guide clip 36 to the hose 26 at the end of the lever 40 serves as a load point for the lever.

Closely spaced from the axis 80, there is provided a stub 82 on the lever 40 forming a force point in the form of pivot. A connecting link 78 is pivotally connected at its respective ends between the stop 76.2 on the final wheel 76 and the force point 82 on the guide lever 40.

Thus, in use, reciprocation of the hose 26, or rather intermittent cyclic movement of the hose 26 in one direction namely in the direction 66 shown in FIG. 2, is transmitted via the lever 44 to the wheel 54 which moves in a corresponding direction in small cyclic steps. Such movement is transmitted at a greatly reduced speed ratio and thus also at a greatly increased torque ratio to the final wheel 76. The connecting link 78 acts like a crank arm to pivot the guide lever 40 in the wiping or swinging fashion indicated by arrows 42. Such wiping or swinging motion is transmitted to the hose 26 at the point where it is engaged by the clip 36 to change the attitude and position of the hose at that point as described above.

By way of development, the guide lever 40 is in the form of two sections which are interconnected in series and are frictionally locked as indicated by reference numeral 86. The frictional locking is effected by means of opposing discs, which could be cogged if desired, on the respective sections of the lever 40 which are then frictionally held in mesh or in frictional engagement. Thus, should the lever arm 40 at its free end, or the hose 26, get stuck, and thus provide too high a load to the arm, the frictional connection 86 acts as a clutch to prevent breakage.

The applicant envisages that the device 30 will be manufactured almost exclusively in the form of synthetic polymeric mouldings which method of manufacture lends itself to mass manufacture. Furthermore, the parts are easily assembled as can be received especially from FIG. 4. Special mention is made of the easy and effective way in which the clip 38 is connected to the lever 44 as shown best in FIG. 3. The other pivot points may be manufactured in like fashion such that, for example, the gear wheels can easily be clipped into stubs provided for those purposes on the body 32. It is thus contended that the device 30 can be manufactured very effectively and at relatively low cost.

It is a further advantage that a friction mechanism is provided to prevent unduly high loads on the device 30.

It is yet further an advantage that the device 30 is driven by means of energy associated with pumping of water by means of the existing pool pumping system. Thus, in the embodiment illustrated, it will not be necessary to provide a dedicated power or energy source. It is however possible, still in accordance with the invention, to provide a dedicated or special power or energy source to drive the device 30.

What is claimed is:

1. A method of operating a pool cleaner which passes water from a head in a pool cleaner body via a hose into and through a pump system of a pool, the flow stream of water being cyclically interrupted in the pool cleaner body to cause a corresponding, cyclic stop-start motion in the body and a cyclic water hammer action and to and fro motion in the hose, the method including, mechanically, continually or continously, moving the hose by cyclicly oscillating the hose at a position remote from the body of the pool cleaner such as to change both the attitude and the location of the hose at said position.

2. A method as claimed in claim 1 in which oscillating is along an arc.

3. A method as claimed in claim 1 in which oscillating is in a horizontal plane generally along the surface of the water.

4. A method as claimed in claim 2 in which oscillating is in a horizontal plane generally along the surface of the water.

5. A method as claimed in claim 1 which includes using energy associated with pumping of the water through the hose to move the hose.

6. A method as claimed in claim 2 which includes using energy associated with pumping of the water through the hose to move the hose.

7. A method as claimed in claim 3 which includes using energy associated with pumping of the water through the hose to move the hose.

8. A method as claimed in claim 4 which includes using energy associated with pumping of the water through the hose to move the hose.

9. A method as claimed in claim 5 which includes transmitting the to and fro motion of the hose to a mechanical device adapted to transduce the to and fro motion into the motion to which the hose is subjected.

10. A method as claimed in claim 9 in which transmitting the to and fro motion of the hose is via a lever, pawl-fashion, to a wheel to rotate the wheel, and which method includes transducing rotation of the wheel to arcuate wiping motion transmitted to the hose.

11. A method as claimed in claim 10, which includes reducing rotation of the wheel in one or more reduction gear steps forming part of a gear train.

12. A method as claimed in claim 11, which includes transmitting rotation of a gear wheel at a downstream end of the gear train by means of a crank mechanism to an arm, the hose being connected to the arm to be moved in concert with the arm.

13. A guiding device suitable for use in operating a pool cleaner which, in use, passes water from a head in a pool cleaner body via a hose into and through a pump system of a pool, the flow stream of water being cyclically interrupted in the pool cleaner body to cause a corresponding, cyclic stop-start motion in the body and a cyclic water hammer action and to and fro motion in the hose, by mechanically, continually or continously, moving the hose at a position remote from a body of the pool cleaner, the device including a driven member arranged to be driven and which is in the form of a lever having a fulcrum, a force point connected to the hose, and a load point connected to a wheel; a transducer connected to the driven member and adapted to transduce motion of the drive member to motion to be imparted to the hose; and a transmission member arranged to transmit motion from the transducer to the hose.

14. A device as claimed in claim 13 in which the load point is releasably connected to the wheel by means of a connection device adapted to connect the load point to the wheel when motion of the lever is in a first direction, and to disconnect the lever from the wheel when motion of the lever is in a second direction opposed to the first direction.

* * * * *